US006843409B2

(12) United States Patent
Park

(10) Patent No.: US 6,843,409 B2
(45) Date of Patent: Jan. 18, 2005

(54) MEDIA CONTAINER MODULE

(75) Inventor: Eung-Min Park, Seoul (KR)

(73) Assignee: LG N-SYS Inc., Seoul (KR)

( * ) Notice: Subject to any disclaimer, the term of this patent is extended or adjusted under 35 U.S.C. 154(b) by 80 days.

(21) Appl. No.: 10/325,927

(22) Filed: Dec. 23, 2002

(65) Prior Publication Data

US 2003/0116623 A1 Jun. 26, 2003

(30) Foreign Application Priority Data

Dec. 24, 2001 (KR) ..... 10-2001-0084334

(51) Int. Cl.[7] ..... B65D 91/00
(52) U.S. Cl. ..... 232/1 D; 232/15; 902/9
(58) Field of Search ..... 232/15, 16, 1 D, 232/43.3; 109/66; 235/79; 902/8, 9

(56) References Cited

U.S. PATENT DOCUMENTS 3,926,366 A * 12/1975 Sciortino ..... 232/15
4,186,977 A * 2/1980 Gilovich et al. ..... 312/215
4,529,118 A * 7/1985 Granzow et al. ..... 232/43.3
4,638,746 A * 1/1987 Ishigure ..... 109/52
4,919,058 A * 4/1990 Isozaki et al. ..... 109/24.1
6,176,423 B1 * 1/2001 Egami ..... 235/379

* cited by examiner

*Primary Examiner*—William L. Miller
(74) *Attorney, Agent, or Firm*—Birch, Stewart, Kolasch & Birch, LLP

(57) ABSTRACT

A media container module includes; a casing having an internal storage space and a media insertion hole formed at one side thereof for inserting a media, and being opened and closed by a door; and a shutter fixing unit having a shutter installed inside the casing and opening and closing the media insertion hole, a second locking unit moved by interacting with an operation key installed at a mounting unit of a mounting device, a first locking unit unlocked by the second locking unit and at the same time moved by the operation key for unlocking to enable the shutter to be moved, a shutter opening unit for opening the shutter when being mounted at the mounting unit of the mounting device; and a shutter fixing member to maintain opening state of the shutter after the shutter is opened.

21 Claims, 10 Drawing Sheets

MEDIA CONTAINER MODULE

BACKGROUND OF THE INVENTION

1. Field of the Invention

The present invention relates to a media dispenser apparatus and, more particularly, to a media container module mounted in a media dispenser apparatus and storing media.

2. Description of the Background Art

Generally, a media dispenser apparatus such as an automated teller machine (ATM) or a cash dispenser (CD) is a system installed in an area where many people pass by, such as a bank, convenience store (CVS) or subway station. The ATM/CD allows a user to withdraw cash with a simple operation.

When the user puts a card or a bankbook into an inlet (in some cases, the user inputs required information using an operator panel or using a portable communication device such as a mobile phone) and follows procedures using the operator buttons according to the instructions shown on a display device on a front surface, then media such as cash or checks and a specification sheet are withdrawn according to the procedures. Generally, the specification sheet is withdrawn through a specification sheet outlet, and the media is provided through a media dispenser module (i.e., a customer access module) on the front surface.

At this time, during the operation procedure, the ATM can malfunction in a state that the media is in the media dispenser module, or in case that the user inadvertently leaves the media in the media dispenser module, the media remaining in the media dispenser module is retrieved into a media container separately mounted for a follow-up normal operation.

In this respect, however, if the media retrieved in the media container is accessible from outside, there is a high possibility of robbery or loss. Thus, the media container must have a suitable security device to prevent such an undesired incident.

SUMMARY OF THE INVENTION

Therefore, an object of the present invention is to provide a media container module of which a media insertion hole can be opened when it is mounted in a mounting portion of a mounting device whereas the media insertion hole is maintained in a closed state when the media container module is separated from the mounting portion.

To achieve these and other advantages and in accordance with the purpose of the present invention, as embodied and broadly described herein, there is provided a media container module including; a casing having an internal storage space and a media insertion hole formed at one side thereof for inserting media into the storage space, and being opened and closed by a door; and a shutter fixing unit having a shutter installed inside the casing, the shutter opening and closing the media insertion hole, a second locking unit moved by interacting with an operation key installed at a mounting unit of a mounting device, a first locking unit being unlocked by the second locking unit and at the same time moved by the operation key for unlocking the shutter to allow the shutter to move, a shutter opening unit for opening the shutter when being mounted at the mounting unit of the mounting device; and a shutter fixing member to maintain the open state of the shutter after the shutter is opened.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Figure 1:
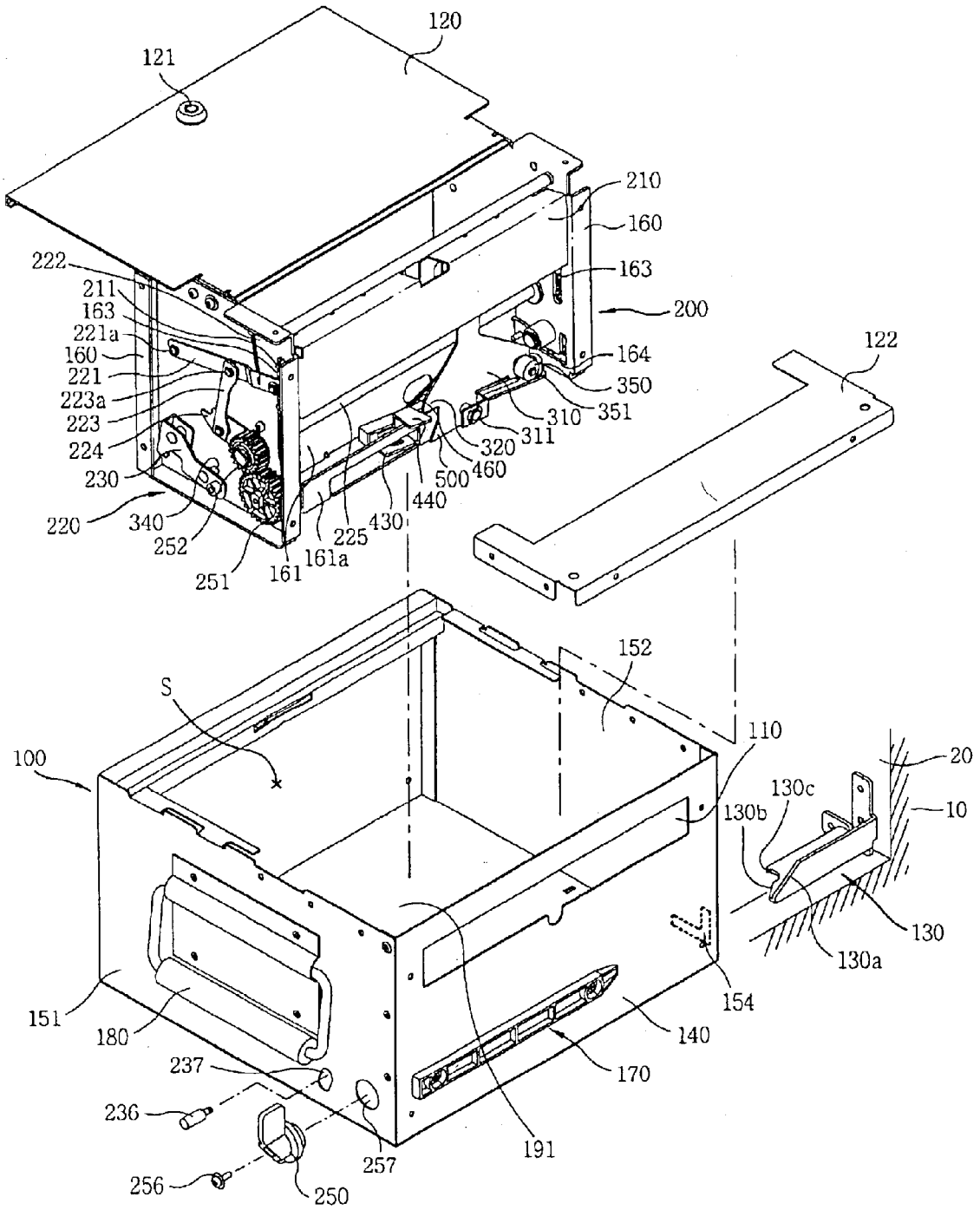
FIG. 1 is an exploded perspective view showing a media container module in accordance with the present invention.
Figure 2:
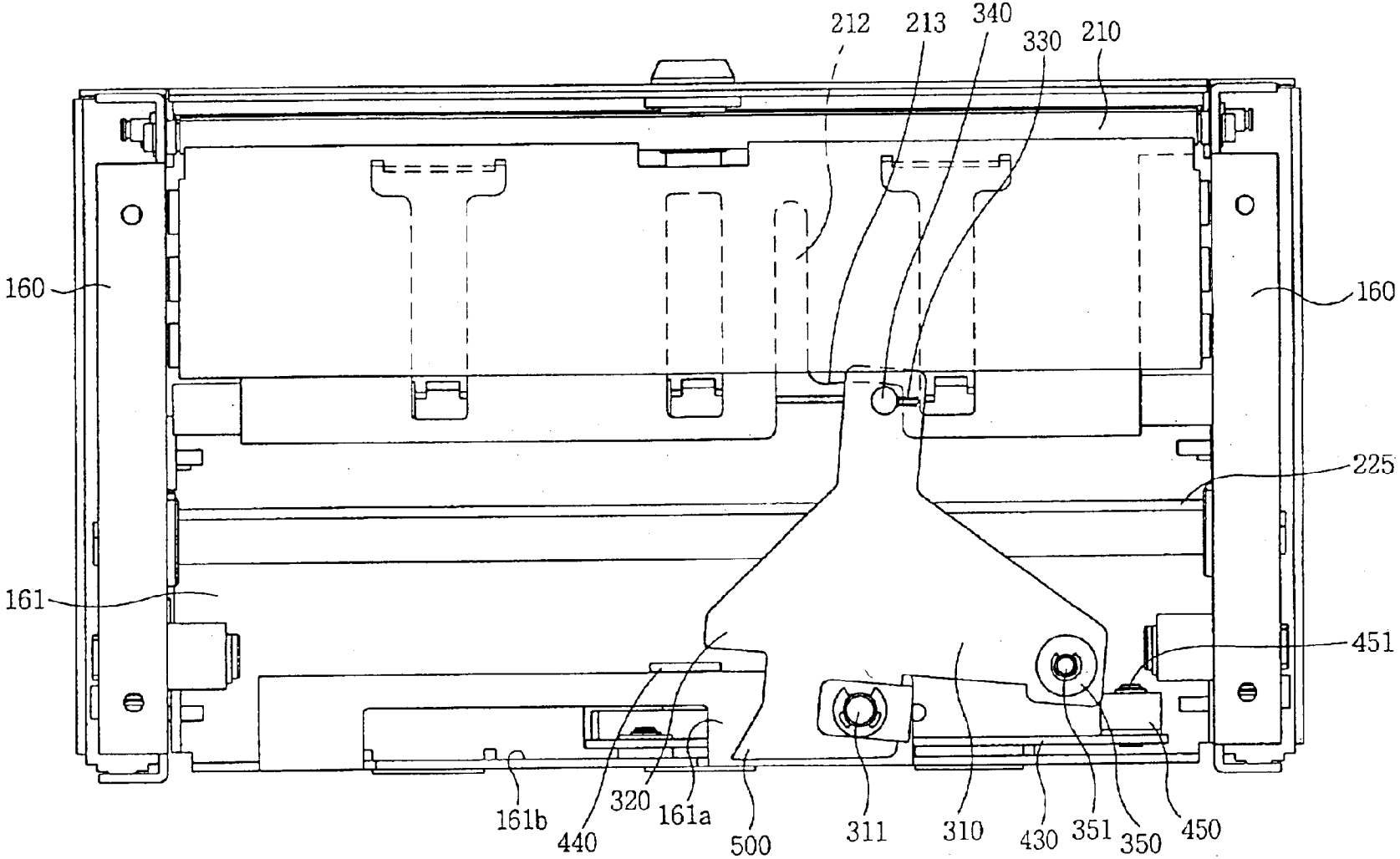
FIG. 2 is a front view showing a shutter opening and closing unit of FIG. 1.
Figure 3:
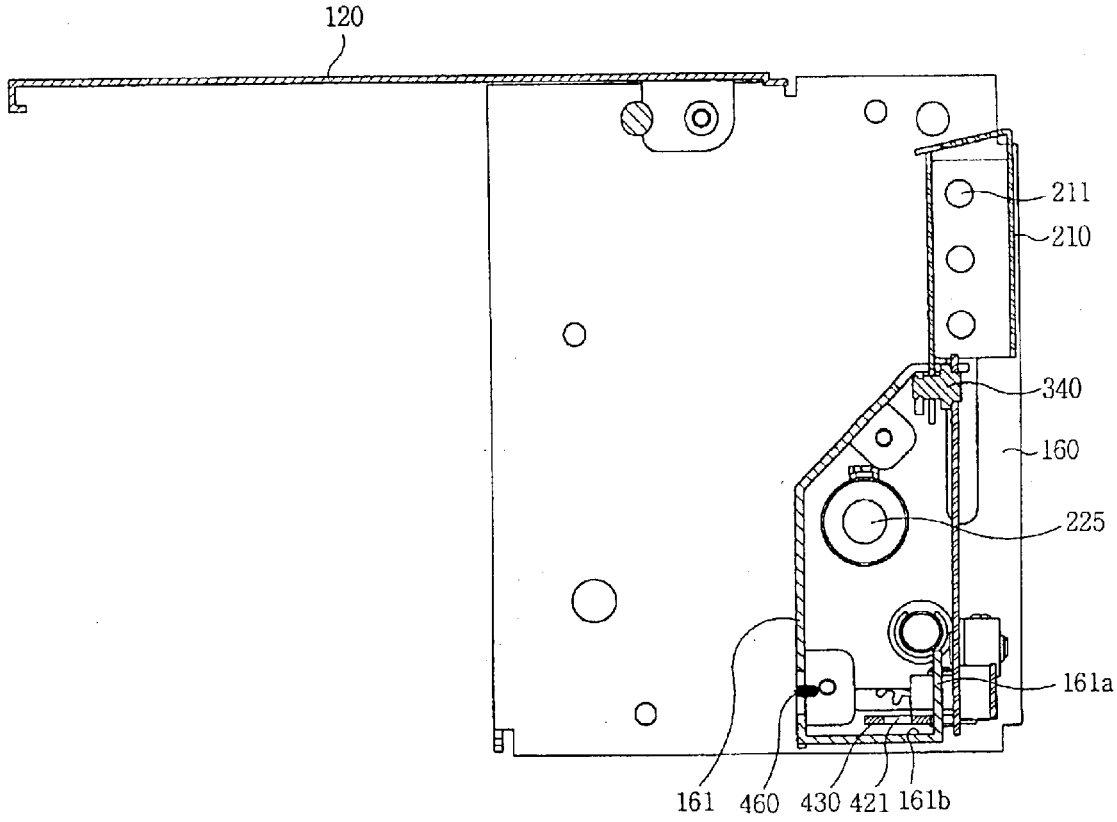
FIG. 3 is a sectional view in the direction of III—III of FIG. 2.
Figure 4:
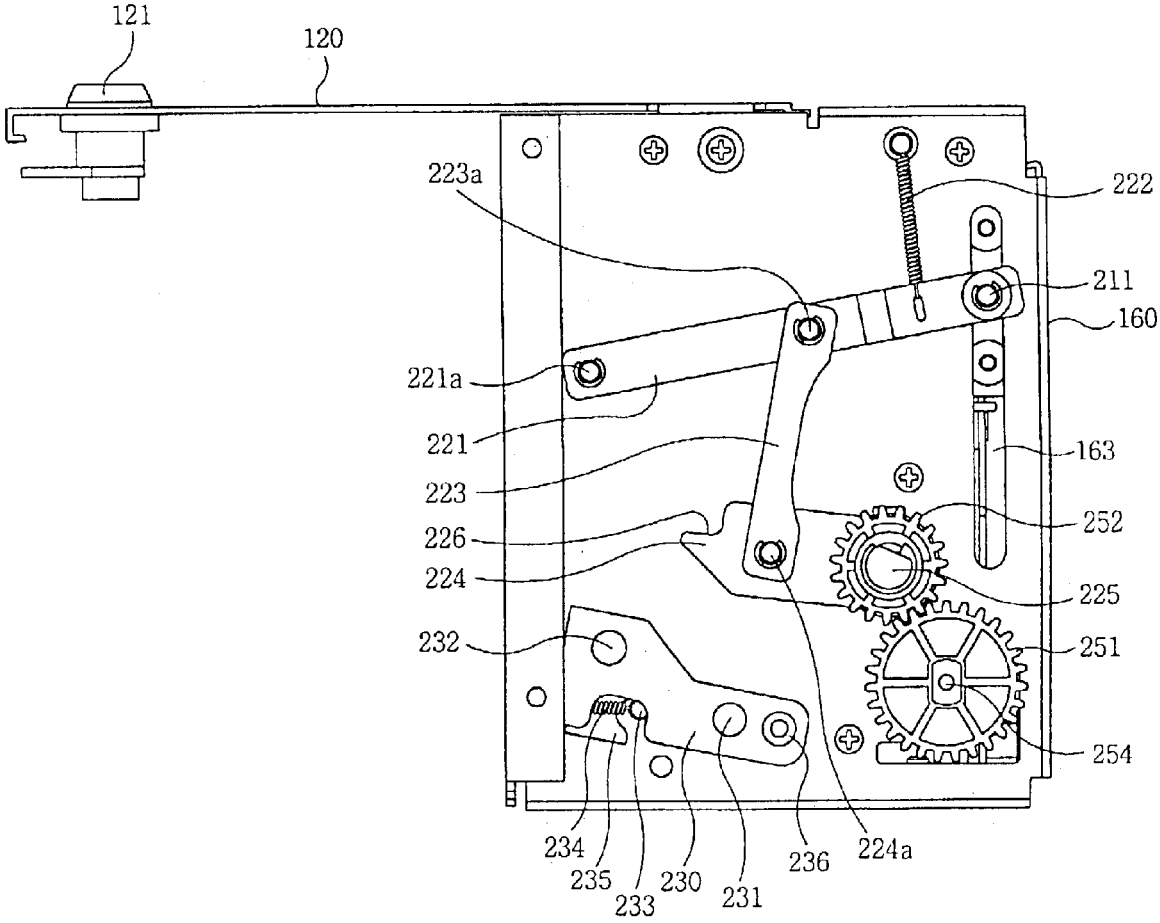
FIG. 4 is a left side view of FIG. 2.

Reference will now be made in detail to the preferred embodiments of the present invention, examples of which are illustrated in the accompanying drawings.

As shown in FIGS. 1 through 8, a media container module in accordance with the present invention includes: a media container module including a casing 100 having an internal storage space S and a media insertion hole 110 formed at one side thereof for inserting media into the storage space, and being opened and closed by a door 120; a shutter 210 installed inside the casing 100, the shutter opening and closing the media insertion hole 110; a second locking unit 400 moved by interacting with an operation key 130 installed at a mounting unit 20 of a mounting device 10; a first locking unit (FIG. 7) being unlocked by the second locking unit (FIG. 8) and at the same time moved by the operation key 130 for unlocking the shutter to allow the shutter 210 to move; a shutter opening unit 220 for opening the shutter 210 when being mounted at the mounting unit 20 of the mounting device 10; and a shutter opening and closing unit 200 having a shutter fixing member 230 to maintain opening state of the shutter 210 after the shutter is opened.

An upper side of the casing 100 is in an opened state, and the opened portion is opened and closed by the door 120 together with a covering plate 122, which has a lock 121 to maintain a door-locked state.

A handle 180 is installed at one of the side walls 151 of the casing 100, which is not in contact with the mounting unit 20, for a user's grasp when the media container module is mounted into or separated from the mounting device 10. A mounting guide member 170 is installed at an outer wall of the casing 100 to guide the casing 100 when being attached to or detached from the mounting device 10.

A pair of separate walls 160 are fixed at both inner sides near the respective side walls 151, 152 of the casing 100, and an inner support plate 161 is fixed between the separate walls 160.

The shutter 210 is installed at an upper side of the inner support plate 161, and one or more protrusions 211 are formed at both end portions thereof and inserted into the slots 163 formed vertically on the respective separate walls 160 so as to be moved in up/down direction along the slots 163.

The first locking unit (FIG. 7) includes a first plate 310 disposed in parallel to an insertion face 140 of the casing 100 having the media insertion hole 110 and rotatably installed at a first rotational shaft 311 installed vertically to the insertion face 140. An engaging jaw 320 is formed on the first plate 310 so as to be engaged with the second locking unit (FIG. 8) so that the first plate 310 can be rotated only by the operation key 130. A locking pin 340 is positioned by a first elastic member 330 at a position digressed from an opening slot 212 formed at the shutter 210 in a direction that the shutter 210 is moved and installed at the first plate 310 to prevent the shutter 210 from being moved; and a first interacting member 350 installed at the first plate 310 and rotating the first plate 310 when it is in contact with the operation key 130 so as to move the locking pin 340 toward the opening slot 212 to enable the shutter 210 to be moved to an opening position.

The first plate 310 is fixed by the first rotational shaft 311 at its lower end portion and rotatably coupled to a vertical bent portion 161*a* bent from a lower end portion of the inner support plate 161 below the shutter 210. The locking pin 340 is fixed at an upper end portion of the first plate 310 to prevent the shutter 210 from moving downwards.

One end portion of the first elastic member 330 is fixed to the locking pin 340 and the other end portion of the first elastic member 330 is fixed at the inner support plate 161, so that when the medium container module is separated from the mounting device 10, the upper end portion of the first plate 310 is elastically pulled clockwise centering on the first rotational shaft 311 not to allow the shutter 210 to be opened, for which the locking pin 340 is moved to the support face 213 to support the lower end portion of the shutter 210, that is, to a position deviated with the opening slot 212 (to be described).

The second locking unit 400 includes first and second guide pins 411, 412 disposed in line in parallel to the insertion face 140; a second plate 430 having a guide slot unit 420 having a proceeding slot 421 and a blocking slot 422 which are connected to each other and formed in an 'L' shape so that when the shutter 210 is in a closed position, the first guide pin 411 is positioned at the proceeding slot 421 and the second guide pin 412 is positioned at the blocking slot, while when the shutter 210 is in an opened position, the first and second guide pins 411, 412 are all positioned at the proceeding slot 421. An engaging plate 440 to which the engaging jaw 320 of the first locking unit 300 is engaged when the shutter 210 is in the locking position, is fixedly installed at the second plate 430 so as to be moved together when the second plate 430 is moved to release the engagement of the engaging jaw 320. A second elastic member 460 is provided for positioning the second plate 430 so that the engaging jaw 320 is engaged to the engaging plate 440 as the second guide pin 412 is positioned at the blocking slot 422 in a state that the casing 100 is separated from the mounting unit 20; and a second interacting member 450 for rotating the second plate 430 to move the second guide pin 412 from the blocking slot 422 to the proceeding slot 421 when being in contact with the operation key 130, and moving the second plate 430 along the proceeding slot 421.

The second plate 430 is coupled to the lower end portion of the inner support plate 161 so as to be slidable in a horizontal direction from the upper side of a horizontal bent portion 161*b* of the inner support plate 161.

One end portion of the second elastic member 460 is fixed at a left end portion of the second plate 430 and the other end portion of the second elastic member 460 is fixedly installed at an inner side of the inner support plate 161. The second elastic member 460 constantly pulls the second plate 430 rightwardly and elastically. Therefore, when the media container module is released from the mounting device 10, the second plate 430 is slidably moved in a direction that the second elastic member 460 is contracted so that the engaging plate 440 formed bent integrally at the left end portion of the second plate 430 supports the engaging jaw 320 of the first plate 310 from the lower side. Thus, the locking state is doubly maintained and thus the shutter 210 is not opened artificially.

The first guide pin 411 protrudingly formed in a vertical direction at the horizontal bent portion 161*b* of the inner support plate 161 is inserted into the proceeding slot 421, so that the second plate 430 can be guided by the first guide pin 411 when being slid in a horizontal direction.

In order not to artificially manipulate and slidably move the second plate 430 through a key hole, the second plate 430 is elastically rotated backwardly (in the casing 100) by the second elastic member 460 when the medium container module is released from the mounting device 10, and the second guide pin 412 installed at a certain distance from the first guide pin can be inserted into the blocking slot 422 connected in an 'L' shape at a left end portion of the proceeding slot 421.

The operation key 130 is inserted into the right side wall 152 of the casing 100 and the right separate wall 160 through through holes 154 and 164 respectively formed in an 'L' shape when the medium container module is mounted in the mounting device 10. The operation key 130 has a sectional shape in an 'L' shape so that the locking pin 340 of the first plate 310 can be positioned at an entrance of the opening slot 212 formed at the shutter 210 by rotating the first plate 310 counterclockwise.

The operation key 130 has a vertical slope portion 130*a* and a horizontal slope portion 130*b* at its end portion so that the first interacting member 350 rotatably coupled at the pin 351 fixed at a right end portion of the first plate 310 goes up on the vertical slope portion 130*a* to rotate the first plate 310 counterclockwise, and at the same time, the second interacting member 45° rotatably coupled at the pin 451 fixed at the right end portion of the second plate 430 is slid along the horizontal slope portion 130*b* to rotate the second plate 430 counterclockwise and release the second guide pin 412 from the blocking slot 422 of the second plate 430. A roller mounting groove 130*c* is formed at a rear end of the horizontal slope portion 130*b* so that the second interacting member 450 installed at the second plate 430 is slid leftwardly, thereby releasing the locking state that the second plate 430 supports the first plate 310 from the lower side via the engaging plate 440 and engaging jaw 320.

The shutter opening unit 220 includes a first link 221 with one end rotatably fixed at one of the protrusions and the other end hinged at the separate wall 160. An elastic member 222 has one end fixedly connected with the first link 221 and the other end fixedly installed at the separate wall 160, and provides elastic force to the shutter 210 so that the shutter 210 can be restored to the closed position to close the media insertion hole 110. A second link 223 has one end hinged at the first link 221. A third link 224 is installed at the separate wall 160, being rotatable centering around a third link shaft 225, and being rotatably connected to the other end of the second link 223 so as to move the second link 223 to rotate the first link 221 and move the shutter 210 to an opening position for opening the media insertion hole 110.

One end portion of the first link 221 is coupled at the protrusion 211 of the shutter 210 at an outer side of the left separate wall 160 and the other end portion of the first link 221 is fixed at the opposite side by a fixing pin 221*a*.

A lower end portion of the elastic member 222 is connected to the first link 221 and an upper end portion thereof is fixed at the upper end portion of the left separate wall 160, so as to elastically pull the opposite side of the first link 221 centering on the fixing pin 221*a* constantly and upwardly.

An upper end portion of the second link 223 is connected to the central portion of the first link 221 by means of a pin 223*a*, being disposed somewhat vertically. A front end portion of the third link 224 is connected to the lower end portion of the second link 223 by means of a pin 224*a* to pull the second link 223 downwardly.

The third link 224 is rotatably installed at the third link shaft 225 which is rotatably installed between the left separate wall 160 and the right separate wall 160 and connects the third links 224 in the left and right separate walls, and a follower gear 252 is coupled at the third link shaft 225 to rotate the third link shaft 225 at a certain angle.

The follower gear 252 is geared with a drive gear 251 coupled at the fixing pin 254 rotatably fixed at the lower side. The fixing pin 254 with the drive gear 251 fixed thereto is protruded to the outer side of the casing 100 through the through hole 257, and a manipulation handle 250 is fixedly coupled at the protruded portion with a bolt 256 so as to interact with the rotation of the drive gear 251 to lower the shutter 210 into the opened position.

The shutter fixing member 230 is rotatably coupled on the left separate wall 160 spaced apart from the drive gear 251 by means of a pin 232. One end portion of a release spring 234 with the other end fixed at the fixing pin 233 is connected to the lower side of the rear end portion of the shutter fixing member 230, so as to apply a spring force to the shutter fixing member 230 to be constantly rotated clockwise.

A stopping portion 235 is fixed at a rear side of the rear end portion of the shutter fixing member 230 to restrain rotation of the shutter fixing member 230 by means of the fixing pin 233. An engaging pin 231 is fixed at a rear portion of a free end portion of the shutter fixing member 230 so that an engaging hook 226 formed at an end portion of the third link 224 can be engaged thereto. A release pin 236 is fixed at a front side of the free end portion of the shutter fixing member 230 in a thread way at an outer side of the casing 100 through a pin slot 237 formed at the casing 100.

Figure 5:
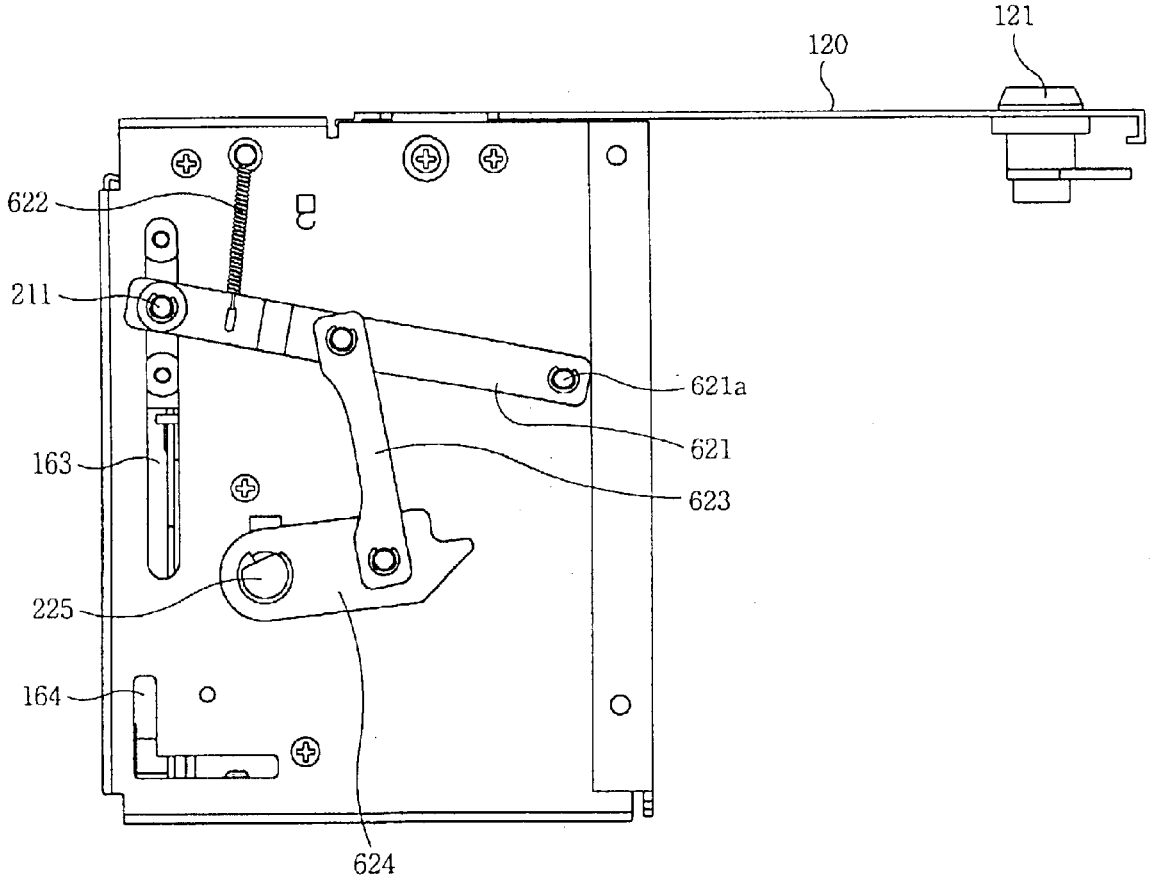
FIG. 5 is a right side view of FIG. 2.
Figure 6:
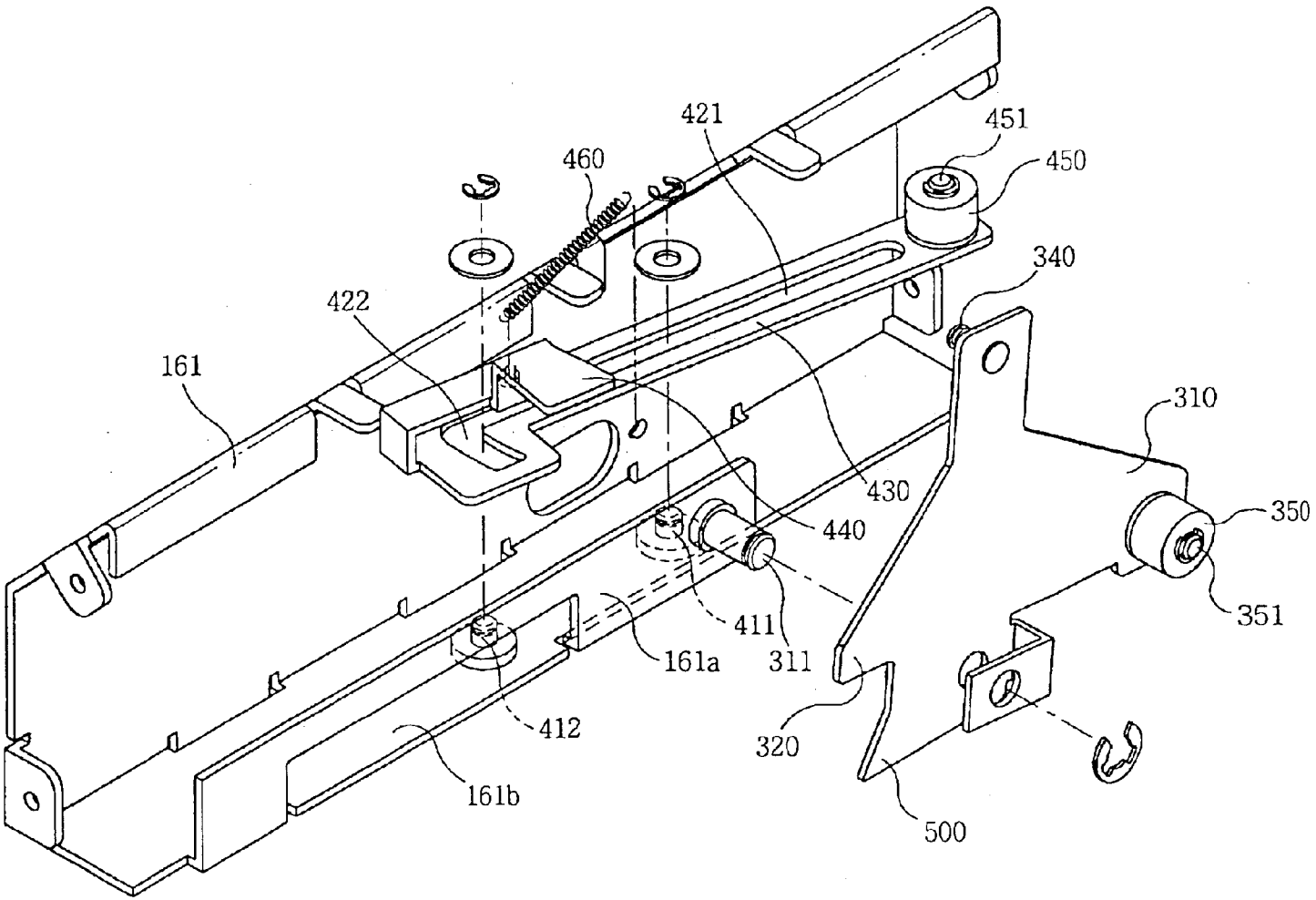
FIG. 6 is a view showing an assembly structure of a major part of FIG. 1.
Figure 7:
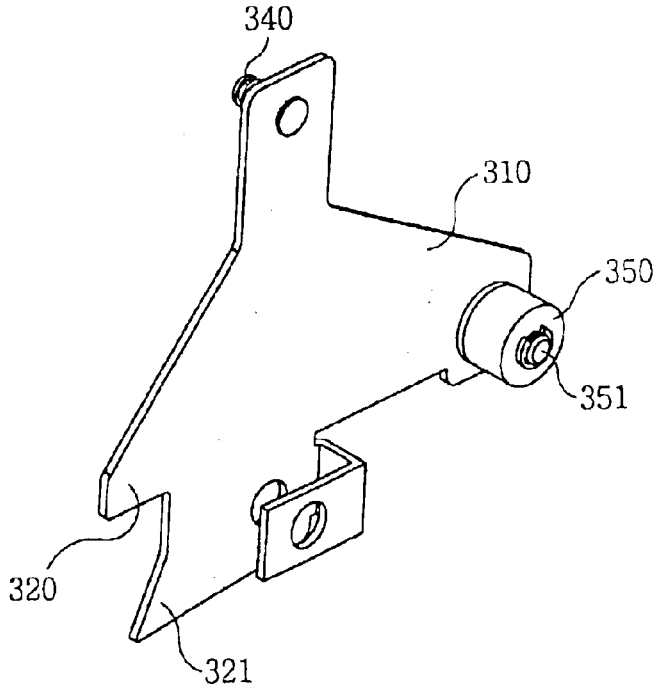
FIG. 7 is a perspective view of a first locking unit of FIG. 1.
Figure 8:
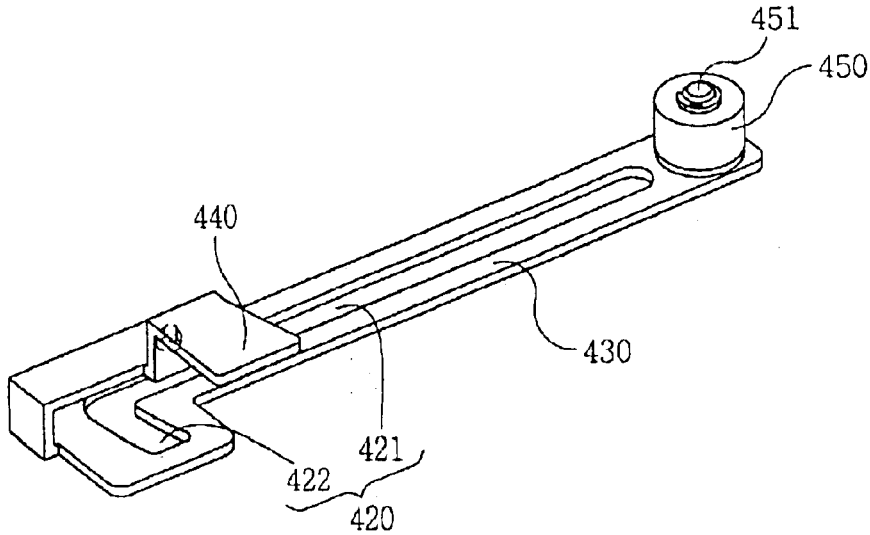
FIG. 8 is a perspective view showing a second locking unit of FIG. 1.

As shown in FIG. 5, link units with the similar construction to that of the left separate wall 160 are formed at an outer side of the right separate wall 160.

That is, a first auxiliary link 621 is installed with a rear end portion at the pin 621*a* of the right separate wall 160 and with a front end portion connected to a right protrusion 211 of the shutter 210. The other end of the elastic member 622 of which one end is fixed at the upper portion of the right separate wall 160 is connected to the first auxiliary link 621. A second auxiliary link 623 disposed vertically is connected to the first auxiliary link 621. A third auxiliary link 624 is fixed at a right end portion of the third link shaft 225.

The media container module of the present invention may additionally include a locking member 500 to prevent the casing 100 from being separated from the mounting unit 20 of the mounting device 10 when the shutter 210 is in the opening position.

Figure 9A:
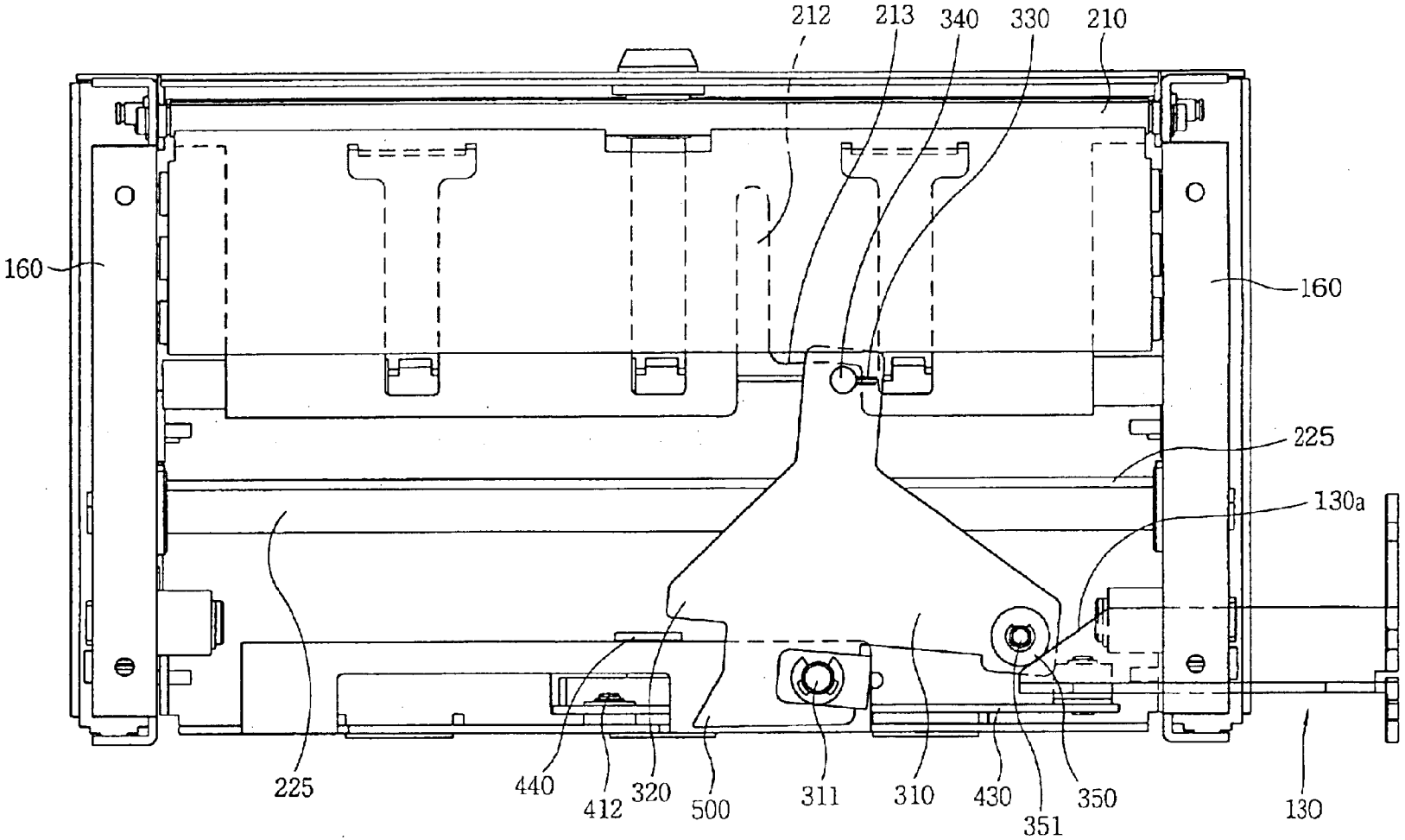
FIGS. 9A, 9B and 9C are front views showing a process of mounting of the media container module of FIG. 1.
Figure 9B:
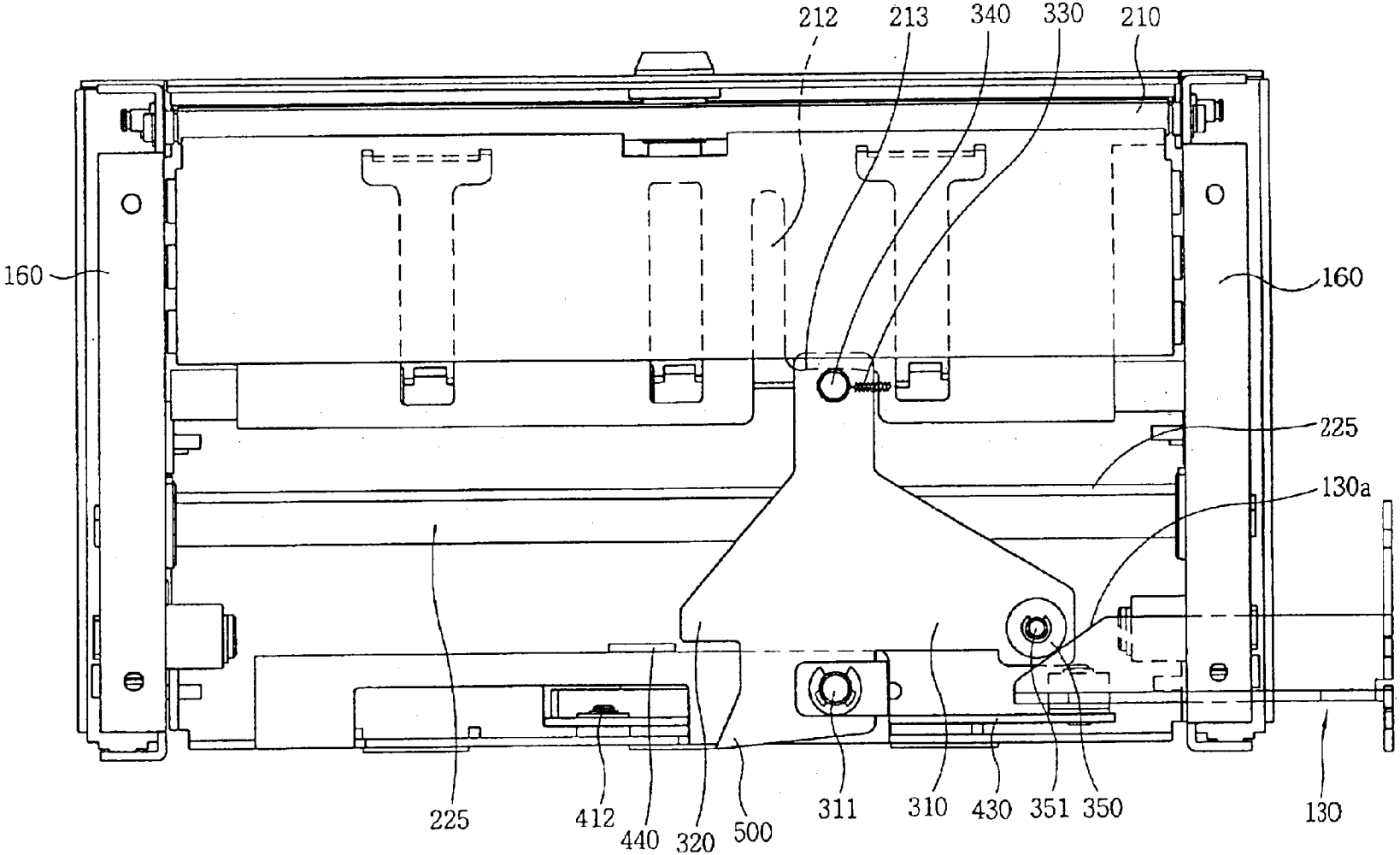
Figure 9C:
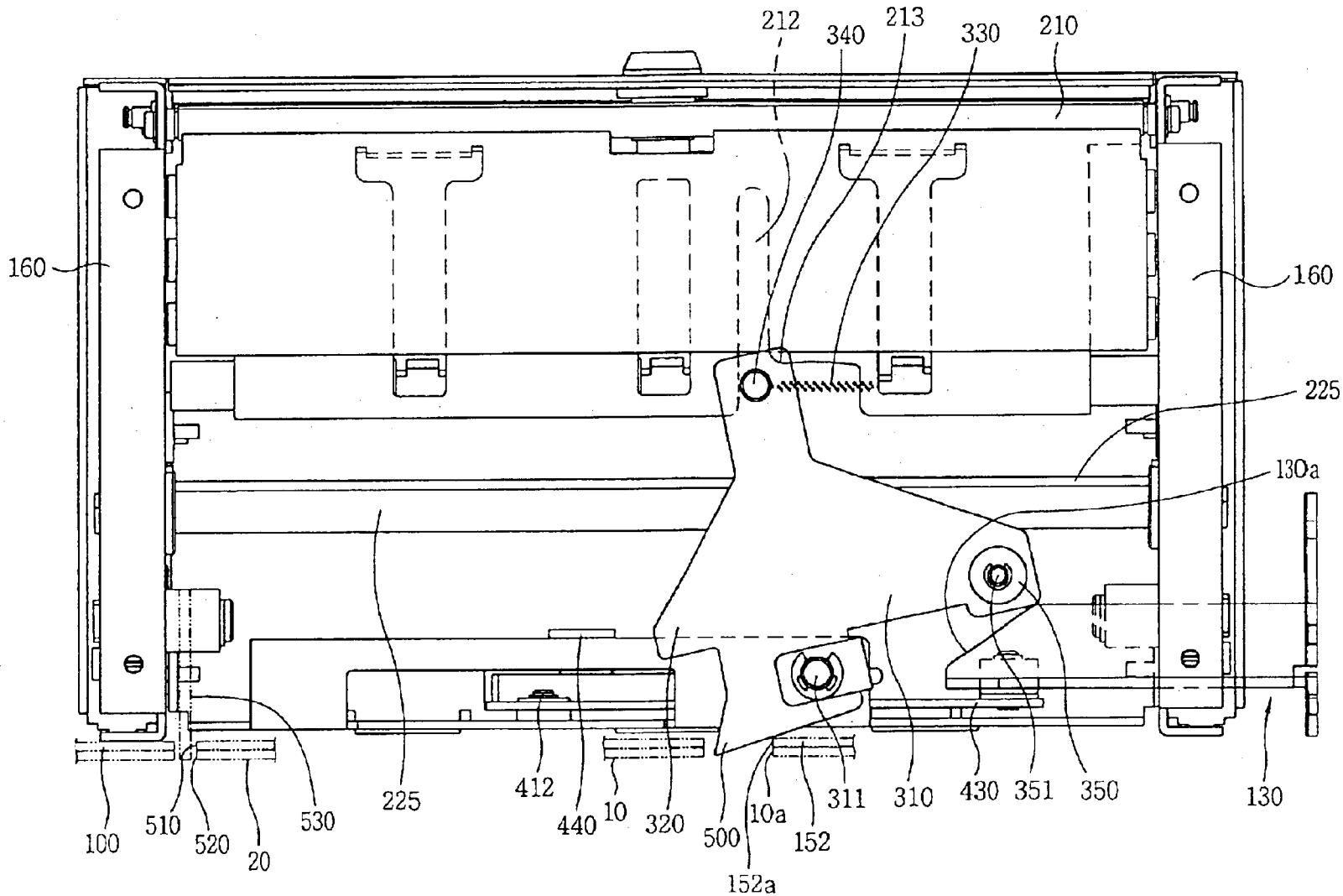

That is, as shown in FIG. 9C, the locking member 500 is formed at the left lower side of the first plate 310 and rotated counterclockwise in an opening position, penetrating the locking member insertion hole 152*a* formed at the lower wall 191 of the casing and being inserted into the insertion hole 10*a* formed at the mounting unit 10, thereby preventing the casing 100 from being separated from the mounting unit 10 in a state that the shutter 210 is in an opening state.

The locking member 500 may additionally include a first locking slot 510 formed at the lower wall 191 of the casing 100; a second locking slot 520 formed at a position corresponding to the first locking slot 510 at the mounting unit 20; and a cam member 530 axially coupled to the drive gear 251 and preventing the casing 100 from being separated from the mounting unit 20 by being inserted into the second locking slot 520 through the first locking slot 510 when the shutter 210 is in the opening position.

The operation of the media container module with the construction as described above will now be explained.

First, an operation for opening the shutter 210 to retrieve the media after the media container module is mounted in the mounting device 10 will now be described with reference to FIGS. 9A, 9B and 9C.

When a user pushes the empty casing 100 into the mounting unit 20 of the mounting device 10 by using the handle 180, as shown in FIG. 9A, the operation key 130 is inserted into the casing 100 through the through holes 154 and 164 respectively formed at the casing 100 and the right separate wall 160. Then, the second interacting member 450 installed at the second plate 430 is in first contact with the horizontal slope portion 130*b* of the operation key 130 being inserted and slidably moved in a horizontal direction. And then, when the front end portion of the second plate 430 is rotated counterclockwise centering around the first guide pin 411 by rotating the rear end portion of the second plate 430 counterclockwise, the second guide pin 412 is positioned at the entrance of the proceeding slot 421, the end of the blocking slot 422 of the second plate 430.

In this state, the casing 100 is continuously pushed. Then, the second interacting member 450 installed at the second plate 430 is mounted in the roller mounting groove 130*c* formed at the operation key 130. Further continuous pushing makes the second plate 430 move leftward, resulting in the locking state of the first plate 310 being released as shown in FIG. 9B.

At the same time, the first interacting member 350 installed at the first plate 310 is slid along the vertical slope portion 130*a* of the operation key 130 and the first plate 310 is rotated counterclockwise centering around the pin 311. Accordingly, as shown in FIG. 9C, the locking pin 340 fixed at the first plate 310 is positioned at the entrance of the opening slot 212 formed at the shutter 210 and the locking state is released and thus, the shutter 210 can be moved downwardly by the shutter opening unit 220. And, the rear surface of the casing 110 is supported at the inner side of the mounting device 10, that is, the media container module is completely mounted in the mounting device 10.

An operation for opening the shutter 210 in a state that the casing 100 is mounted in the mounting device 10 will now be described.

When the user holds the handle 250 installed at the outer side of the casing 100 and rotates the handle 250 clockwise, the drive gear 251 is rotated clockwise and the follower gear 252 is rotated counterclockwise.

Accordingly, the third link shaft 225 with the follower gear 252 fixed thereto is rotated counterclockwise to rotate the end portion of the third link 224 counterclockwise. Then, the second link 223 connected to the third link 224 is moved downwardly and pulls the first link 221 so that the first link 221 can be rotated clockwise centering around the fixing pin 221*a*, so as to descend the shutter 210 connected to the protrusion 211. Therefore, in a state that the shutter closes the media insertion hole 110 formed at the side of the casing 100, the media insertion hole 110 is opened, so that media can be conveyed into the storage space of the casing 100 through the media insertion hole 110 when the mounting device 10 is operated.

If the third link 224 is rotated at beyond a certain angle counterclockwise, the engaging hook 226 formed at the end portion of the third link 224 is engaged at the engaging pin 231 of the shutter fixing member 230. Thus, in a state that the casing 100 is mounted in the mounting device 10, the media insertion hole is maintained in the opening state at the media insertion hole 110 of the casing 100 to retrieve the media into the casing 100.

An operation that the shutter 210 is closed, the casing 100 is disassembled and the locking is made not to open the shutter 210 in a state that the casing is mounted in the mounting device 10 will now be described. The disassembling operation is performed conversely to the mounting operation.

That is, when the user removes the casing 100 from the mounting device, he/she pushes the release pin 236 downwardly. Then, the engaging pin 231 descends together and the shutter fixing member 230 elastically connected by the release spring 234 is rotated clockwise centering around the pin 232 to release the third link 224 engaged with the engaging pin 231. And at the same time, the second link 223 and the front end portion of the first link 221 ascend by virtue of the spring force of the left elastic member 222 and the second auxiliary link 623 and the front end portion of the first auxiliary line 621 ascent by virtue of the spring force of the right elastic member 622. Then, the shutter 210 connected to the first link 221 and the front end portion of the first auxiliary link 621 ascend, and accordingly, the shutter 210 closes the media insertion hole 110 of the casing 100.

In this state, in order to remove the casing 100 from the mounting device 10, when the user pulls out the casing 100 by holding the handle 180, the first interacting member 350 installed at the first plate 310 is slid along the vertical slope portion 130*a* of the operation key 130 and the first plate 310 is rotated by virtue of the pulling force of the first elastic member 330. Then, the locking pin 340 released from the opening slot 212 of the shutter 210 supports the lower end portion of the shutter 210, and the casing 100 is disassembled from the mounting device. In this manner, the first locking is performed so that someone else can not open the shutter 210 artificially.

In this state, if the user keeps pulling the casing 100, the second plate 430 is pulled by the second elastic member 460 and the second interacting member 450 installed at the second plate 430 is slid along the horizontal slope portion 130*a* of the operation key 130. The second plate 430 is slid rightward in a state of being guided to the first guide pin 411 and the engaging plate 440 is moved downwardly of the engaging jaw 320 of the first plate 310, thereby making a second locking.

When the second plate 430 is completely moved rightward, the second guide pin 412 is moved to the blocking slot 422 formed at the left end of the proceeding slot 421 by virtue of the pulling force of the second elastic member 460, thereby making a complete locking operation. Thus, in a state that the casing 100 is disassembled from the mounting device 10, someone else can not easily release the locking state by pulling the second plate 430 through the through holes 154 and 164 of casing 100 and the right separate wall 160.

Especially, in case that the user intends to separate the casing 100 from the mounting unit 20 of the mounting device 10 in a state that the media insertion hole 110 is open, he/she should separate the casing 100 from the mounding device 20 in a state the shutter closes the media insertion hole 110 because the casing 100 will not be separated from the mounting device 20 due to the locking member 500.

As so far described, the media container module of the media of the media dispenser apparatus such as an automated teller machine in accordance with the present invention has the following advantages.

That is, when the media container is mounted in the mounting device, the shutter is opened, while when the media container module is disassembled from the mounting device, the first locking unit supports and locks the lower end portion of the shutter. Thus, after the media container module is disassembled from the mounting device, someone else can not open the shutter and draw out the media retrieved through the entrance of the casing, thereby preventing the retrieved media from being stolen.

In addition, since the locking state of the shutter is maintained double by supporting the lower side of the first locking unit by means of the second locking unit installed at a rear portion of the lower side of the first locking unit, someone can not open the shutter intentionally by manipulating the first locking unit through the through hole into which the operation key is inserted.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. A media container module comprising;

a casing having a storage space and a media insertion hole formed therein for inserting media into or remove media from the storage space;

a shutter unit having a shutter installed inside the casing and opening and closing the media insertion hole;

a first locking unit having a first position and a second position, wherein said first locking unit locks the shutter in a position closing the media insertion hole when in the first position and unlocks the shutter to permit the shutter to be opened when in the second position;

a second locking unit having a blocking position and a releasing position, wherein the second locking unit holds the first locking unit in the first position when in the blocking position and allows the first locking unit to move to the second position when in the releasing position;

an operation key installed at a mounting unit of a mounting device, wherein the operation key physically interacts with the second locking unit to cause the second locking unit to move to the releasing position, and wherein the operation key physically interacts with the first locking unit to cause the first locking unit to move to the second position; and a shutter opening unit for opening the shutter when the media container module is mounted at the mounting unit of the mounting device.

2. The module of claim 1, wherein a pair of separate walls are fixedly installed space apart at sides of the casing adjacent to an insertion face having the media insertion hole.

3. The module of claim 2, wherein each separate wall includes a slot extending in a direction which is substantially parallel to a plane of the insertion face, and at least one or more protrusions are installed at both end portions of the shutter and are inserted into the slot to linearly guide the shutter along the slot.

4. The module of claim 3, wherein the shutter opening unit comprises:

a first link with one end rotatably fixed at one of the protrusions and the other end rotatably hinged at one of the separate walls;

an elastic member with one end fixedly installed at the first link and the other end fixedly installed at the one of the separate walls, and providing an elastic force to the shutter tending to restored the shutter to a position to close the media insertion hole;

a second link with one end hinged at the first link; and a third link fixedly installed to be rotatable centering around a third link shaft at the one of the separate walls, the third link being rotatably connected to the other end of the second link so as to move the second link by rotation and rotate the first link, to thereby move the shutter to a position to open the media insertion hole.

5. The module of claim 4, wherein a shutter fixing member is rotatably installed at the one of the separate walls and has a free end with an engaging pin, and the engaging pin is engaged with an engaging hook formed at a free end of the third link when the shutter comes to the opening position, thereby fixing the shutter at the opening position.

6. The module of claim 5, wherein the shutter fixing member includes a release pin which protrudes outwardly through a pin slot formed at the side of the casing, wherein movement of the release pin causes the engaging pin to release the engaging hook in order to close the shutter.

7. The module of claim 2, wherein the shutter opening unit is installed at both separate walls.

8. The module of claim 4, wherein the third link shaft extends between the separate walls, so that when one side thereof is rotated, the other side thereof is rotated together.

9. The module of claim 4, wherein the shutter opening unit includes an opening member which is connected to the third link and rotates the third link about the third link shaft, so as to move the shutter to an opening position.

10. The module of claim 9, wherein the opening member is fixedly installed at an outer side of the casing and coupled to a first gear installed rotatably at the one of the separate walls, and the first gear is engaged with a second gear which is axially coupled to the third link shaft.

11. The module of claim 10, further comprising:

a locking arrangement having a first locking slot formed at the bottom of the casing, a second locking slot formed at a position in the mounting device corresponding to the first locking slot, and a locking member coupled to the first locking unit, wherein the locking member is inserted into the second locking slot through the first locking slot and prevents the casing from being separated from the mounting unit when the shutter is in the opening position.

12. The module of claim 1, wherein the first locking unit comprises:

a first plate disposed in parallel to a plane of an insertion face having the media insertion hole, the first plate being installed rotatably about a first rotational shaft installed perpendicular to the insertion face;

an engaging jaw formed on the first plate so as to be engaged with the second locking unit;

a locking pin attached to the first plate and positioned by a first elastic member at a position digressed from an opening slot formed at the shutter to prevent the shutter from being opened; and a first interacting member installed at the first plate and rotating the first plate in response to contact with the operation key so as to move the locking pin toward the opening slot to enable the shutter to be moved to an opening position.

13. The module of claim 12, wherein the second locking unit comprises:

first and second guide pins extending in a direction parallel to the plane of the insertion face with the medium insertion hole;

a second plate having a guide slot unit having a proceeding slot and a blocking slot which are connected to each other and formed in an 'L' shape so that when the shutter is in a closed position, the first guide pin is positioned at the proceeding slot and the second guide pin is positioned at the blocking slot, while when the shutter is in an opened position, the first and second guide pins are both positioned at the proceeding slot;

an engaging plate to which the engaging jaw of the first locking unit is engaged when the shutter is in the closed position, wherein the engaging plate is fixed to the second plate so as to be moved together when the second plate to release the engagement of the engaging jaw;

a second elastic member for positioning the second plate so that the engaging plate engages the engaging jaw when the second guide pin is positioned at the blocking slot in a state that the casing is separated from the mounting unit; and a second interacting member for rotating the second plate to move the second guide pin from the blocking slot to the proceeding slot upon contact with the operation key, and for moving the second plate along the proceeding slot.

14. The module of claim 12, wherein the operation key includes a slope face formed at a portion thereof to contact with the first interacting member in order to rotate the first plate about the first rotational shaft.

15. The module of claim 13, wherein the operation key includes a slope face or an engaging hook to contact with the second interacting member to thereby rotate the second plate and to also move the second plate along the proceeding slot.

16. The module of claim 1, wherein a through hole is formed at a side of the casing being in contact with the mounting unit into which the operation key can be inserted.

17. The module of claim 1, wherein a mounting guide member is installed at an outer wall of the casing to guide mounting of the casing into the mounting unit of the mounting device.

18. The module of claim 1, wherein a handle is installed on a side of the casing which is opposite to a side of the casing where the operation key enters the casing.

19. The module of claim 1, wherein the shutter opening unit includes a locking member for preventing the casing from being separated from the mounting unit of the mounting device when the shutter is in the opening position.

20. A media container module comprising;

a casing having a storage space and a media insertion hole formed at one side thereof for inserting media into the storage space, and being opened and closed by a door; and a shutter fixing unit having a shutter installed inside the casing and opening and closing the media insertion hole, a second locking unit moved by interacting with an operation key installed at a mounting unit of a mounting device, a first locking unit unlocked by the second locking unit and at the same time moved by the operation key for unlocking the shutter to allow the shutter to be moved, a shutter opening unit for opening the shutter when being mounted at the mounting unit of the mounting device; and a shutter fixing member to maintain an open state of the shutter after the shutter is opened, wherein a pair of separate walls are fixedly installed space apart from the side at both inner sides of the casing adjacent to an insertion face having the media insertion hole.

21. A media container module comprising;

a casing having a storage space and a media insertion hole formed at one side thereof for inserting media into the storage space, and being opened and closed by a door; and a shutter fixing unit having a shutter installed inside the casing and opening and closing the media insertion hole, a second locking unit moved by interacting with an operation key installed at a mounting unit of a mounting device, a first locking unit unlocked by the second locking unit and at the same time moved by the operation key for unlocking the shutter to allow the shutter to be moved, a shutter opening unit for opening the shutter when being mounted at the mounting unit of the mounting device; and a shutter fixing member to maintain an open state of the shutter after the shutter is opened, wherein a mounting guide member is installed at an outer wall of the casing to guide mounting of the casing into the mounting unit of the mounting device.

* * * * *